US005799346A

United States Patent [19]

Tiernan

[11] Patent Number: 5,799,346

[45] Date of Patent: Sep. 1, 1998

[54] DUAL SHOWER HEAD DEVICE

[76] Inventor: Mark R. Tiernan, 6970 Jackson Ct., Merrillville, Ind. 46410

[21] Appl. No.: 791,366

[22] Filed: Jan. 30, 1997

[51] Int. Cl.[6] ..... A47K 3/22

[52] U.S. Cl. ..... 4/601; 4/615; 211/105.6; 285/31; 239/267; 239/281; 239/282

[58] Field of Search ..... 4/601, 615, 557, 4/558, 607, 608, 610; 239/551, 267, 280.5, 281, 282; 285/31, 61, 64; 211/105.6

[56] References Cited

U.S. PATENT DOCUMENTS

| | | | |
|---|---|---|---|
| D. 282,200 | 1/1986 | Haug . | |
| 1,207,380 | 12/1916 | Duffy . | |
| 1,218,879 | 3/1917 | Luzzi . | |
| 1,255,396 | 2/1918 | Eaton . | |
| 1,876,389 | 9/1932 | Bird et al. | 239/282 |
| 2,100,186 | 11/1937 | Hagopian | 4/601 |
| 2,277,562 | 3/1942 | Schu . | |
| 2,336,402 | 12/1943 | Kaiser . | |
| 2,540,159 | 2/1951 | Antrim . | |
| 3,074,740 | 1/1963 | Zastrow | 211/105.6 |
| 3,822,826 | 7/1974 | Wilson . | |
| 3,913,839 | 10/1975 | Wilson . | |
| 4,118,087 | 10/1978 | Dorf | 211/105.6 |
| 4,158,896 | 6/1979 | Farkas | 4/558 |
| 4,545,083 | 10/1985 | Searson | 4/615 |
| 5,052,224 | 10/1991 | Ford et al. | 285/31 |
| 5,390,853 | 2/1995 | Ellul | 239/282 |

OTHER PUBLICATIONS

Newspaper Article Entitled: *Hit The Showers* from the Chicago Tribune,publication of Friday, Feb. 23, 1996 (The "Your Place" section, Section 8, pp. 10 and 11.).

Catalog Entitled: *Health* (a Sears Catalog) from May 26, 1993–"Special Shower Faucets and Portable Bidet" section, p. 10.

Catalog Entitled: *Sporty's Preferred Living Catalog*, Clermont Airport, Batavia, OH 45103–9747—Apr. 2, 1991, Item No. 1864T "Fog-Free Shower Mirror".

*Primary Examiner*—Charles R. Eloshway

*Attorney, Agent, or Firm*—Richard G. Kinney

[57] ABSTRACT

A dual shower head device having elongated tubular sections that are connected in a telescopic manner to form an elongated unit is disclosed. The elongated telescoping tubes serve to adjust the length of the device to fit a particular tub/shower enclosure, to aid in securing the unit in place between opposite walls of the enclosure, and to allow the unit to be compressed for ease in installing and positioning the unit in place between the walls, and to provide a conduit for moving water. A helical spring is compressed within the tubular unit and serves to urge the tubular sections apart and to secure the device between the walls of the enclosure. Rubber bumpers are secured to the ends of the unit for contacting the walls of the enclosure and a shower head is mounted at one end and directed inward and a second shower head is secured to a diverter which is connected to the conventional shower pipe and, via a flexible hose, to the unit. The diverter is manually controlled to apply water to the first shower head, or to both shower heads at the same time.

8 Claims, 4 Drawing Sheets

DUAL SHOWER HEAD DEVICE

FIELD OF THE INVENTION

This invention relates to personal showers and is particularly related to a dual shower head device or assembly for use in substitution for the conventional single shower head in personal shower enclosures.

BACKGROUND OF THE INVENTION

Dual shower head devices are shown in U.S. Pat. Nos. 3,913,839 and 3,822,826 that extend between the side walls of a bath tub enclosure and provide two shower heads, one at each wall, to be directed to the volume between the walls. Both of these devices employ threaded screw pressure to secure the device between the walls.

The use of such a screw pressure attachment is difficult for many people, resulting in excessive pressure in some cases (e.g. resulting in the cracking of tile, or punching a hole through wall board) or insufficient pressure in other cases (resulting in the device slipping or falling down). Thus, here exists the need for a device that is easy to install and will not apply to much or too little pressure.

SUMMARY OF THE INVENTION

In achieving this goal, the present invention provides one improvement in a dual shower head device of the elongated type that includes a unit that extends between opposite walls of a tub or shower enclosure. The device has a shower head at or near each longitudinal end, and the present invention incorporates the improvement of having the unit be made of telescoping tubing which can longitudinally expand or contract over a range to accommodate different distances between the opposite walls of an enclosure. An elongated helical spring is compressed within the telescoping tubing so as to urge the tubing to telescopically expand longitudinally outward against the walls. The unit can also be telescopically compressed to less than the distance between the walls for ease in installing and positioning the unit in the enclosure.

The invention, together with further advantages and features thereof, may best be understood by reference to the following description, taken in connection with the accompanying drawings, in the several figures of which like reference numerals identify like elements.

DETAILED DESCRIPTION

Figure 1:
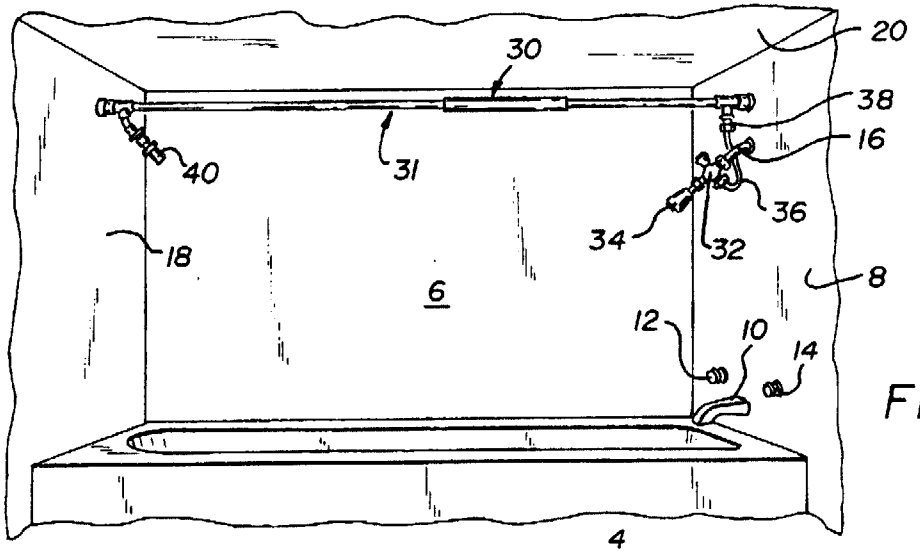
FIG. 1 is a perspective side view of a dual shower head device constructed in accordance with the present invention and installed in an ordinary bath tub shower enclosure.

Referring now to FIG. 1, there is depicted a more or less conventional bath tub 4 which is enclosed on three sides by a side wall 6, and a front wall 8 and a rear wall 18. A conventional spigot 10 and hot and cold water controls 12 and 14 and shower pipe 16 are mounted on the wall 8 in the more or less conventional positions. The spigot 10 may include a diverter for directing water from it to the pipe 16, or any similar water directing means may be employed. Opposite the front wall 8 is a rear wall 18 and a ceiling 20 is also provided. A shower curtain and rod, or other means for keeping water within the enclosure surrounding the tub 4, would conventionally be provided, but is not shown in FIG. 1 for clarity of the illustration of the invention.

In accordance with the present invention, a dual shower head device 30 is provided extending between the walls 8 and 18. The device 30 includes an elongated, generally tubular unit 31. At the end of the pipe 16 is a manually operated diverter valve 32 which functions to feed water to a shower head 34 connected to it, or to that shower head and also through a flexible hose 36 connected at 38 to the tubular unit 31 and to a shower head 40. The valve 32 serves to supply water to shower head 34 alone, or to both shower heads 34 and 40. The shower head 34 is directed or aimed more or less, as would a conventional single shower head connected to pipe 16. When water is fed through the hose 36, it is fed through unit 31 to the second shower head 40 mounted to the unit 31 near the wall 18, but directed inwardly.

Figure 2:
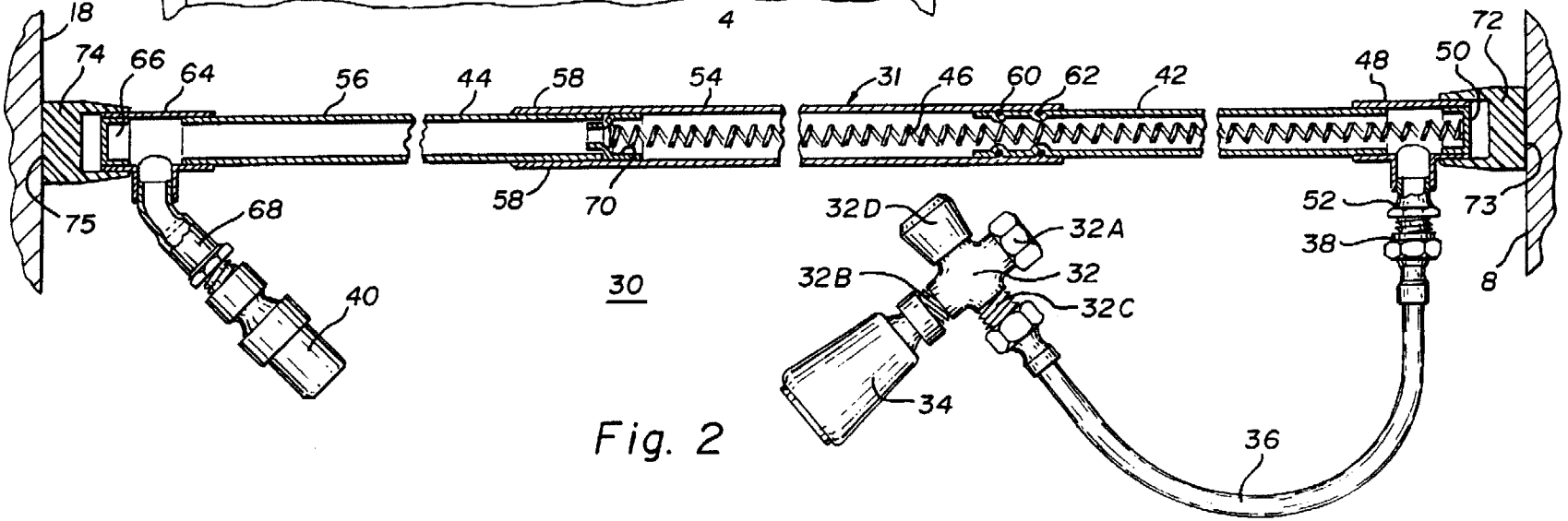
FIG. 2 is primarily a longitudinal sectional view of the main portion of the dual shower head device of FIG. 1 with parts broken away to better show the construction of the device at an enlarged scale.

In FIG. 2, the device 30 is shown in more detail. The diverter valve 32 has a female thread coupling 32A, for connection to the pipe 16, a threaded male coupling 32B for connection to the shower head 34 and a threaded male coupling 32C for connection to the hose 36. A manually operated member 32D opens or closes the pathways within diverter valve 32. By pulling the member 32D out or pushing it in, the water entering coupling 32A is sent to the shower head 34, or to both shower head 34 and to the hose 36 and ultimately to the shower head 40. That is, valve 32 selects to send water to shower head 34 alone, or to both shower heads 34 and 40. The diverter 32 may be, a ALSONS Model 4923 manufactured by Alsons of Hillsdale, Mich.

Figure 9:
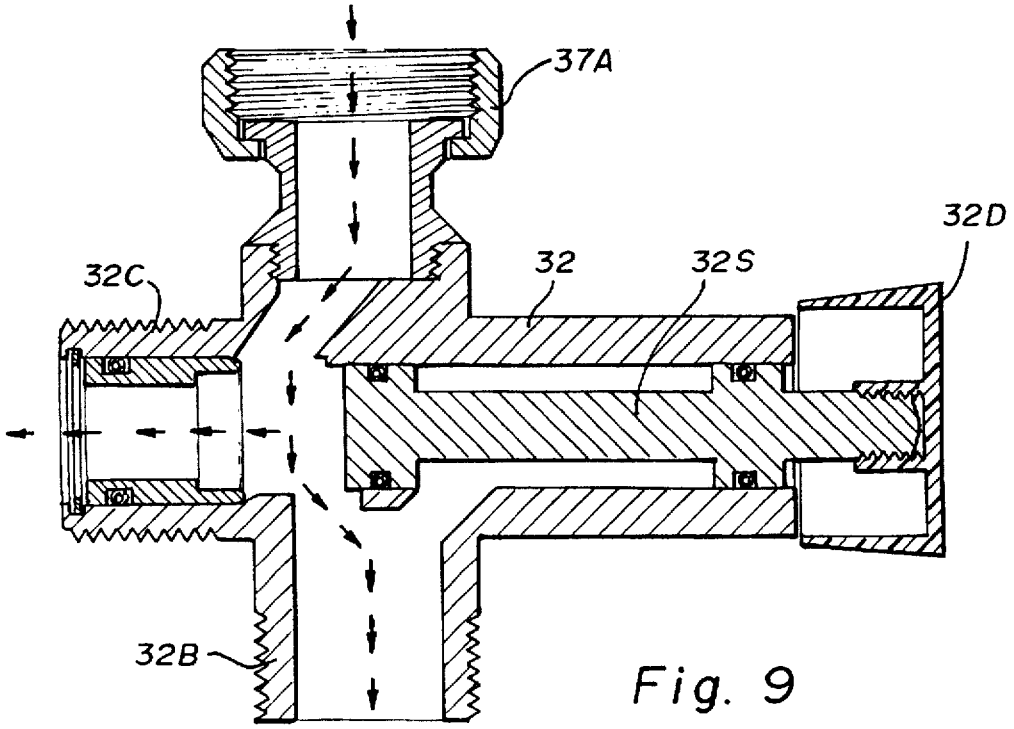
FIG. 9 and FIG. 10 are sectional views of a part, a valve, of the first embodiment of FIG. 1 through FIG. 7 shown in "open" and "closed" positions.
Figure 10:
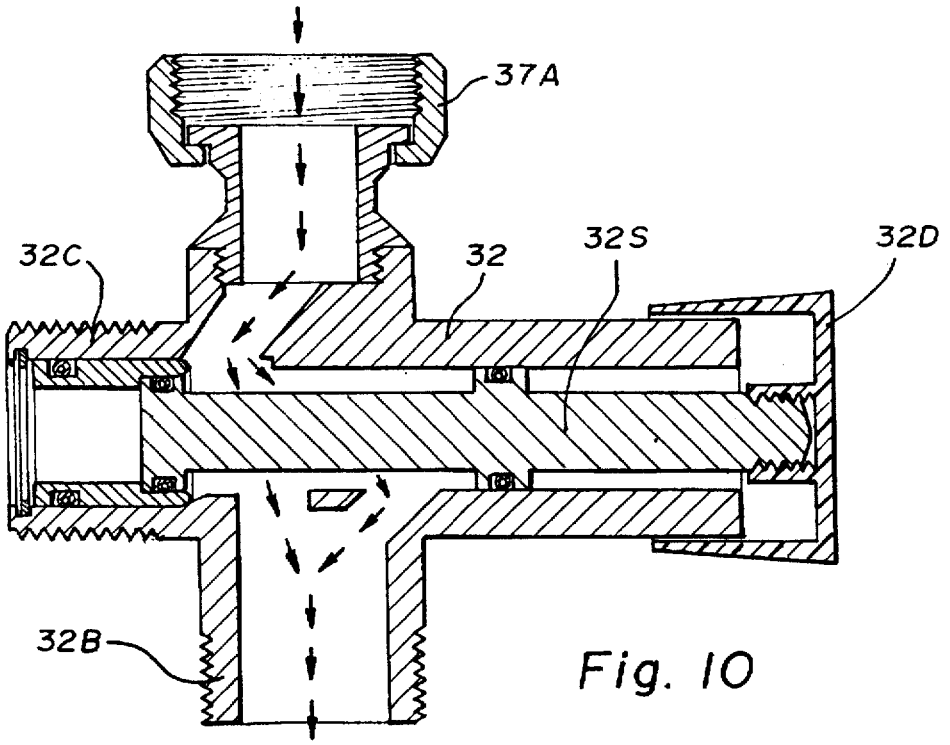

In even more detail, the internal construction of the valve 32 is shown in FIG. 9 and FIG. 10. FIG. 9 illustrates the open position wherein water (arrows) is shown flowing into inlet 32A and outlets 32C and 32B. The valve housing mounts a stem 32S which is moved by member 32D from the open position of FIG. 9, to the closed position shown in FIG. 10. In this arrangement, the stem closes off flow through outlet 32C but allows water flow (again indicated by the arrows) for inlet 32A to outlet 32B.

The hose 36 may also be, as depicted, a standard 12 inch hook up hose, for example Model SA-12A sold under the trademark BRASSCRAFT and manufactured by Brasscraft of Elkhart, Ind. Similarly, the shower heads 34 and 40 may be conventional, commercially available shower heads. The head 34 is preferably, as depicted, a Model SS-2 sold under the trademark SUPER SAVER and manufactured by Teledyne Water Pik of Fort Collins, Colo. which is intended at a maximum flow of 2.5 gallons per minute. The head 40 is preferably, as depicted, a Model SS-2 sold under the trademark SUPER SAVER and manufactured by Teledyne Water Pik of Fort Collins, Colo. which is rated at a maximum flow of 2.5 gallons per minute.

As these may be conventional, commercially available units, it is not necessary to detail them here further. Of course, while these specific models are acceptable, and indeed preferable, it should be noted that many other shower heads, other diverters, and other hoses can be used in the present invention.

One major feature of the present invention is the construction of the tubular unit 31. This has three major parts: a front tube section 42 that is telescopically received in a rear tubular section 44 and a helical spring 46.

The section 42 has at one end connected into one of the main branches of a Tee 48. The Tee 48 is sealed by a cap or plug 50 at its opposite main branch. The cap 50 serves as a seat for one end of the spring 46. The middle branch of the Tee 48 is connected to the male coupling adapter 52, which serves as the connection point 38 for the hose 36.

As stated above, the section 42 is telescopically received into the section 44. The section 44 is preferably made up of two preferably conventional tube sections; a larger diameter middle section 54, and a narrower diameter section 56 that is sized to be closely received in the left end of the section 54 and is brazed or otherwise connected in a solid, leak-proof manner, along the overlapping section 58 between the two tubes.

The tube section 42 is slid into the larger diameter section 54 and a seal is maintained by means of a pair of "O" rings 60 and 62 (preferably made out of neoprene material) positioned in grooves formed about the outer surface of the tube section 42, near its left end.

The tube section 56 is received in and affixed in a leak-proof manner in one side of a second Tee 64. The other side of the Tee 64 is sealed by a cap or plug 66 and the base of the Tee 64 has a male coupling 68 soldered, or otherwise sealed and secured on it. The coupling 68 preferably includes a 45 degree elbow and coupling adapter and is directed to the front and has the shower head 40 threaded on its other end.

The spring 46, at one end, is seated inside the cap 50 and at its other end is seated in a reduced diameter member 70 that is preferably soldered in place within tube 54 just forward of the forward end of the tube 56.

At each end of the unit 31 is secured a rubber or the like bumper 72 and 74. These bumpers 72 and 74 are press-fitted over the caped portion of the Tees 48 and 64 in a tight fit and provide a flat surface 73 and 75 for bearing against walls, such as the walls 8 and 18. Commercially available cane or crutch tips can be employed for the bumpers 72 and 74.

Now, the spring 46 is sufficiently strong as to push the section 42 outward from the tube 31 and must be compressed for the device 30 to achieve the configuration of FIG. 1 and FIG. 2. It is this spring force that presses the bumpers against the walls and hold the device 30 in place.

Figure 3:
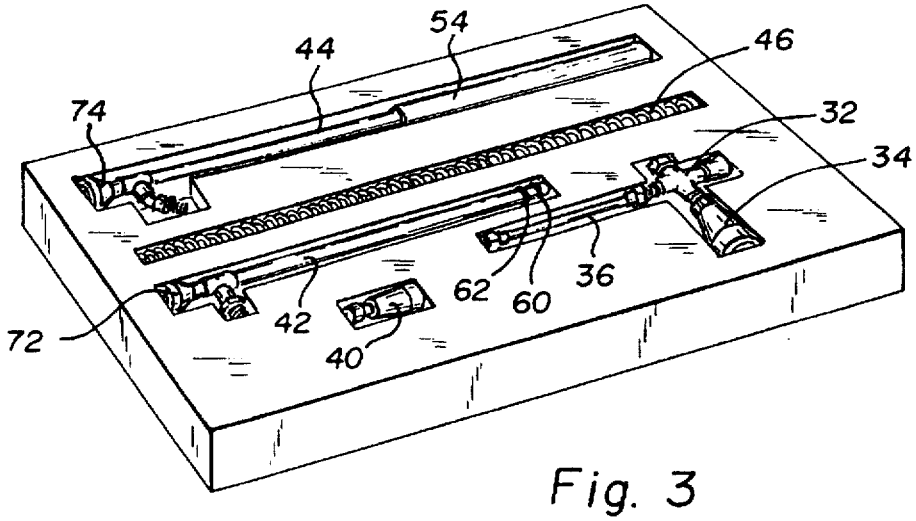
FIG. 3 is a kit of parts for assembling the dual shower head device of FIG. 1 and FIG. 2.

The device 30 is preferably sold and shipped in a knocked-down kit such as the kit 30K shown in FIG. 3 or a spiral shipping tube. The kit consists of the section 44, the section 42 (with "O" rings 60 and 62 in place), the spring 46, the head 40, and the head 34 affixed to the diverter 32, which is affixed to the hose 36, all mounted in a suitable package as shown. The bumpers 72 and 74 are also pre-installed.

Figure 4:
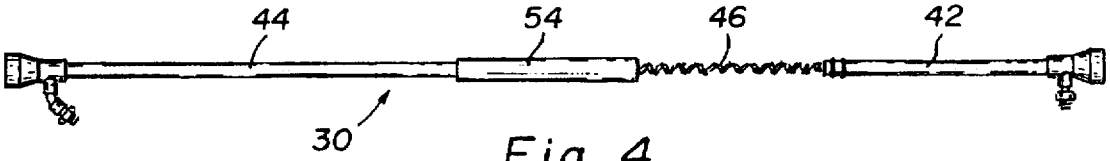
FIG. 4 is a side elevational view illustrating the first step in the assembly and installation of the kit of FIG. 3 into the assembled device of FIG. 1 and FIG. 2.

The kit 30K is assembled and installed as follows: First insert one end of the spring into the open end of the section 44. Insert the open end of the section 42 as shown in FIG. 4. Second, compress the spring and by pushing the open end of Section 42 into the open end of tube 54. The open end of this tube section 54 is preferably, as shown in FIG. 2, reamed to more easily receive the open end of tube 42.

Figure 5:
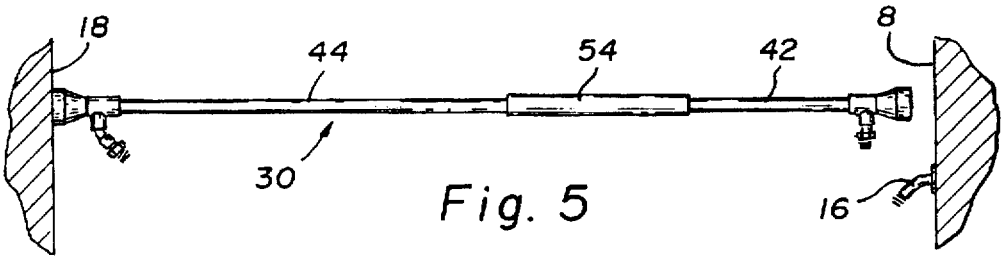
FIG. 5 is a view similar to that of FIG. 4 with parts in a moved position and the walls of the tub enclosure shown in section, illustrating the next step in installing the device.
Figure 6:
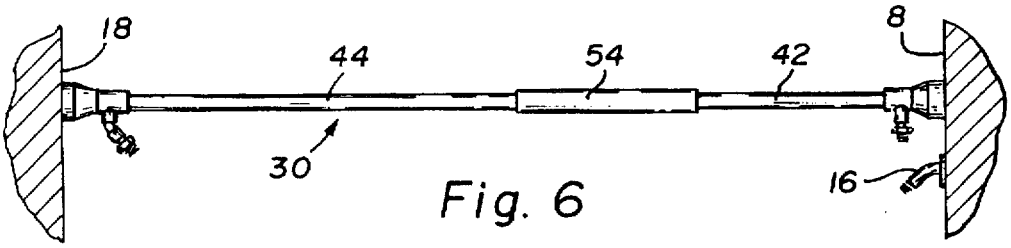
FIG. 6 is a view similar to that of FIG. 5 but with parts in a moved position.

(This compression and inserting step can be accomplished by placing the bumper 74 on the floor and leaning the bumper 72.) With the unit 30 compressed to less than the distance between the walls 8 and 18, place the unit 30 between those walls at a desired position a short distance from the pipe 16 as shown in FIG. 5. The friction between the "O" rings and the tubular sections normally allow the unit 30 to be compressed, as shown in FIG. 5, and to stay compressed, for a short period of time to allow the positioning of the device between the walls before the spring moves the tube 42 outward into engagement with the walls.

Figure 7:
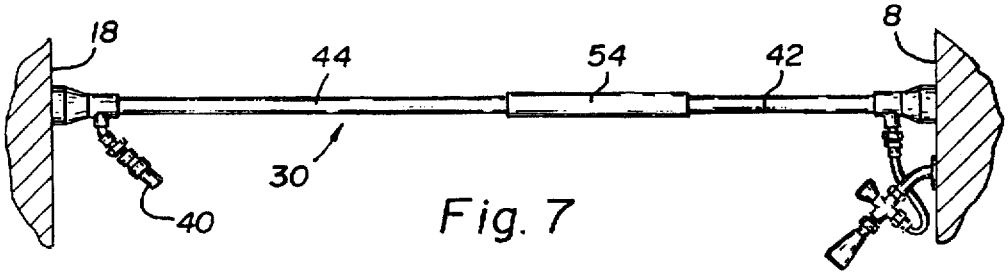
FIG. 7 is a view similar to that of FIG. 5 and FIG. 6 illustrating the final steps in assembling and installing the completed device of FIG. 1 through FIG. 6.

The last step is to thread on the shower head 34 and 40, the diverter 32, and the hose 36 onto their respective connections, as shown in FIG. 7 and FIG. 1. It should be noted that, while in use, water flows through the hose 36 and through the tubes 42 and 44, in and around the spring 46 (which is preferably made of stainless steel). The dual use of the tubes to both telescopically adjust the length of the device 30 so as to fit a range of distances between the walls of the enclosure as well as to carry water to the second shower head, is one of the advantages and features of this invention.

The spring 46 is deliberately long so that the force is kept within a desired range, and to allow for a variation within a range of the distance between the walls 8 and 18.

Figure 8:
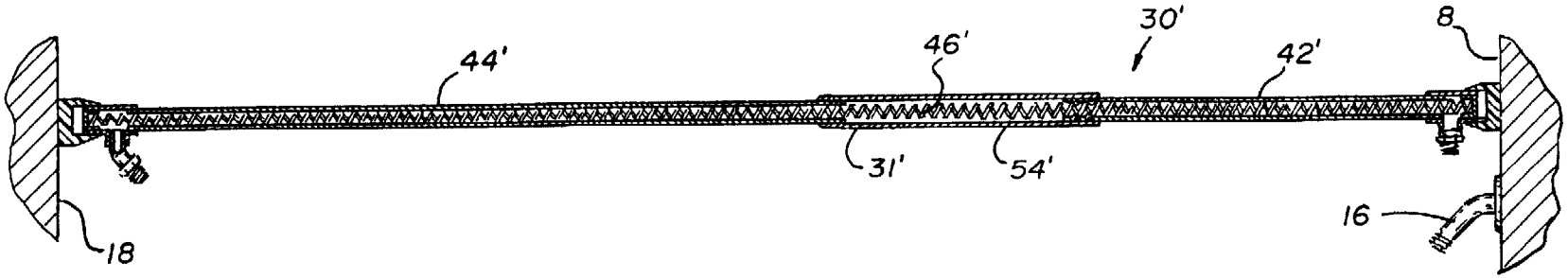
FIG. 8 is a sectional view of an alternative construction of the dual shower head device constructing a second embodiment of the invention.

FIG. 8 illustrates a modification, or second embodiment 30', where the spring 46' runs the entire length of the unit 30, or about 57 inches, in the compressed state. This arrangement allows the telescopic expansion with a decrease in spring force of less than 2% per inch of expansion. The spring 46' of this second embodiment 30' is preferably an (uncompressed) length of 61.0 inches.

A prototype of the device 30 has been constructed and tested and shown to work well. This prototype used the aforementioned specific components for the shower heads 34 and 40, diverter 32, and hose 36. The Tees 44 and 64 were ¾ by ¾ by ½ I.D. inch copper, the caps 50 and 60 were ¾ inch O.D. The spring 46 was 27½ inches long and made of stainless steel with a wire cross section diameter of about 13/16 inches and about 0.8 of a turn per inch (uncompressed). The tube 56 was of thin walled (M) ¾ inch copper about 33 inches long. The tube 42 was of thick walled (K) ¾ inch diameter copper tubing about 20 inches long. The central tubing was of copper, ⅞ I.D. inch in diameter, and was approximately 1/64 inch in thickness. The "O" rings were set into grooves cut 1/16 inch deep, about ½ inch and 1¼ inch from the open end of the tube 42. The "O" rings were each 3/32 inch in cross sectional thickness, and ⅝ inch outside diameter and were made of neoprene. The soldered connections were all made with leadless solder. All visible copper parts were nickel chrome plated to provide better visual appearance and longer life.

While particular embodiments of the invention have been shown and described, it will be obvious to those in the art that changes and modifications may be made without departing from the invention and, therefore, the aim in the appended claims is to cover all such changes and modifications as fall within the true spirit and scope of the invention.

I claim:

1. In a dual shower head device of the elongated type that includes a unit that extends between opposite walls of a tub or shower enclosure and has a shower head at or near each longitudinal end, the improvement comprising:

the unit being made of telescoping tubing which can longitudinally expand or contract over a range to accommodate different distances between the opposite walls of a tub or shower enclosure;

means for seating against a wall at both longitudinal ends of said device;

an elongated helical spring compressed within said telescoping tubing so as to urge the tubing to telescopically expand longitudinally outward against the walls, but which can also be telescopically compressed to less than that distance for ease in installing and positioning said unit in the enclosure, said telescoping tubing serving as the water pathway for feeding water to at least one of the shower heads.

2. The improvement of claim 1 wherein said telescoping tubing have sealing means between the parts that telescope relative to one another to prevent water leaking from the unit.

3. The improvement of claim 2 wherein said sealing means comprises at least one O-ring seated in a circular groove formed in one of said telescoping tubes.

4. A dual shower head fixture for fitting between opposite spaced-apart walls, comprising in combination:

a) first tube means having a closed end and a fitting to receive a shower head at said closed end, and a tubular opening at its other end;

b) second tube means having a water inlet fitting at one closed end and an open end for telescopically connecting with said tubular opening of said first tube means;

said first tube means and said second tube means being telescopically received, one within the other over a portion of their length, with:

c) seal means at the area of reception between the two tubes;

d) an elongated, coiled spring within said telescopically received first and second tube means, said spring serving to urge them apart; and e) means at each of the closed ends of said tubes for seating against a wall;

whereby said first tube means and said second tube means may be received in a telescoping manner with said spring compressed within said first and second tube means, and serving to press said seating means against the opposite walls as to releasably secure the fixture there between.

5. The fixture of claim 4 wherein said first and second tube means, when telescopically received, serve to define a water pathway between inlet fitting and said fitting to receive a shower head.

6. The fixture of claim 5, wherein:

said coil spring extends substantially the length of the first and second tube means, when said tube means are telescopically received one within the other, said coil spring being inside said water pathway defined by said first and second tube means.

7. The fixture of claim 5 wherein the walls are spaced-apart by approximately five feet and the assembled fixture can be telescopically compressed to less than five feet for insertion and positioning between the spaced-apart walls, but expands to press said seating means against the walls under force provided by compression of said coiled spring and to thereby hold the fixture into place.

8. The fixture of claim 7 wherein:

said seal means provided between the first and second tube means, at the area of telescopic reception, is at least one O-ring seated into at least one groove formed around at least one of said first and second tube means.

* * * * *